US006679821B1

(12) United States Patent
Numata et al.

(10) Patent No.: US 6,679,821 B1
(45) Date of Patent: Jan. 20, 2004

(54) CENTRIFUGAL SEPARATOR AND ADMINISTRATION OF USER AND ACTUAL OPERATION OF THE SAME

(75) Inventors: Satoshi Numata, Hitachinaka (JP); Noriyasu Matsufuji, Hitachinaka (JP); Hisanobu Oyama, Hitachinaka (JP); Mitsutoshi Yotsuyanagi, Yokohama (JP); Kazuyoshi Tokunaga, Hitachinaka (JP); Kahoru Takahashi, Hitachinaka (JP)

(73) Assignee: Hitachi Koko Co., Ltd., Tokyo (JP)

( * ) Notice: Subject to any disclaimer, the term of this patent is extended or adjusted under 35 U.S.C. 154(b) by 254 days.

(21) Appl. No.: 09/679,810

(22) Filed: Oct. 5, 2000

(30) Foreign Application Priority Data

Oct. 5, 1999 (JP) ..... 11-283997
Oct. 5, 1999 (JP) ..... 11-283998

(51) Int. Cl.[7] ..... B04B 13/00
(52) U.S. Cl. ..... 494/10; 494/11
(58) Field of Search ..... 494/1, 7–12, 20, 494/84, 85; 422/72

(56) References Cited

U.S. PATENT DOCUMENTS 4,244,513 A * 1/1981 Fayer et al.
4,873,633 A * 10/1989 Mezei et al. ..... 356/39
4,889,524 A * 12/1989 Fell et al. ..... 494/12
5,518,493 A * 5/1996 Srinivasan
5,578,269 A * 11/1996 Yaremko et al. ..... 422/64
5,769,811 A * 6/1998 Stacey et al. ..... 604/4.01
5,871,435 A * 2/1999 Numata et al.
5,926,387 A * 7/1999 Furst

FOREIGN PATENT DOCUMENTS

JP 9-117695 5/1997

* cited by examiner

*Primary Examiner*—Charles E. Cooley
*Assistant Examiner*—David Sorkin
(74) *Attorney, Agent, or Firm*—McDermott, Will & Emery

(57) ABSTRACT

A centrifugal separator includes an input section for allowing a user to enter operating conditions of a centrifugal separation of a sample accommodated in a rotor driven by a motor. A memory of the centrifugal separator stores a user ID code and a corresponding user name which are registered in advance by the user. Operation of the centrifugal separator is allowed when a user ID code entered through the input section agrees with the registered user ID code.

21 Claims, 15 Drawing Sheets

FIG. 2A

USER LIST

| No. | User Name | ID Code | REGISTERED |
|---|---|---|---|
| 1 | Hitachi | * * * * | 1999/10/01 |
| 2 | Suzuki | * * * * | 1999/10/20 |
| 3 | T. Sato | * * * * | 1999/10/22 |
| 4 | MIURA-01 | * * * * | 1999/11/30 |
| 5 | Lipo. Gr | * * * * | 1999/12/10 |
| 6 | C. Lee | * * * * | 1999/12/22 |
| 7 | Michael | * * * * | 1999/12/27 |
| 8 | Johnson | * * * * | 2000/01/14 |
| 9 | | | |

21

● SELECT NO. BY "UP" AND "DOWN" KEY, THEN PUSH "ENTER" KEY

● RENEW PAGE BY "RIGHT" AND "LEFT" KEY

FIG. 2B

USER LIST

| No. | User Name | ID Code | REGISTERED |
|---|---|---|---|
| 1 | Hitachi | * * * * | 1999/10/01 |
| 2 | Suzuki | * * * * | 1999/10/20 |
| 3 | T. Sato | * * * * | 1999/10/22 |
| 4 | MIURA-01 | * * * * | 1999/11/30 |
| 5 | Lipo. Gr | * * * * | 1999/12/10 |
| 6 | C. Lee | * * * * | 1999/12/22 |
| 7 | Michael | * * * * | 1999/12/27 |
| 8 | Johnson | * * * * | 2000/01/14 |
| 9 | | | |

22

● WHAT DO YOU WANT ?
1 : REGISTRATION 2 : CHANGE
3 : DELETION

FIG. 2C

REGISTRATION OF USER NAME

23 ABC Lab.

"CURSOR" KEY : CHARACTER SELECTION (CURSOR SHIFT)
"0~9" KEYS : NUMERICAL VALUES
"MENU" KEY :
UPPER CASE/LOWER CASE CONVERSION
":" : RETURN ONE CHARACTER
"HOLD" KEY : ADVANCE ONE CHARACTER
"ENTER" KEY : SELECT CHARACTER

CHARACTER STRING REGISTRATION
MOVE ON "SET" . THEN PUSH "ENTER" KEY

| | | | | |
|---|---|---|---|---|
| a | b | c | d | e |
| f | g | h | i | j |
| k | l | m | n | o |
| p | q | r | s | t |
| u | v | w | x | y |
| z | / | . | - | % |
| | | | | SP |

SET

24

FIG. 2D

USER LIST

| No. | User Name | ID Code | REGISTERED |
|---|---|---|---|
| 1 | Hitachi | * * * * | 1999/10/01 |
| 2 | Suzuki | * * * * | 1999/10/20 |
| 3 | T. Sato | * * * * | 1999/10/22 |
| 4 | MIURA-01 | * * * * | 1999/11/30 |
| 5 | Lipo. Gr | * * * * | 1999/12/10 |
| 6 | C. Lee | * * * * | 1999/12/22 |
| 7 | Michael | * * * * | 1999/12/27 |
| 8 | Johnson | * * * * | 2000/01/14 |
| 9 | ABC Lab. | | |

● ENTER "ID" CODE

25

FIG. 2E

USER LIST

| No. | User Name | ID Code | REGISTERED |
|---|---|---|---|
| 1 | Hitachi | * * * * | 1999/10/01 |
| 2 | Suzuki | * * * * | 1999/10/20 |
| 3 | T. Sato | * * * * | 1999/10/22 |
| 4 | MIURA-01 | * * * * | 1999/11/30 |
| 5 | Lipo. Gr | * * * * | 1999/12/10 |
| 6 | C. Lee | * * * * | 1999/12/22 |
| 7 | Michael | * * * * | 1999/12/27 |
| 8 | Johnson | * * * * | 2000/01/14 |
| 9 | ABC Lab. | * * * * | 2000/01/20 |

26 27

● SELECT NO. BY "UP" AND "DOWN" KEY, THEN PUSH "ENTER" KEY

● RENEW PAGE BY "RIGHT" AND "LEFT" KEY

FIG. 4A

MENU SCREEN

1. SCHEDULING OF CENTRIFUGE
2. USER LIST
3. ALARM INFORMATION
4. ROTOR CATALOG
5. USER CUSTOMIZATION ROUTINES

41

● ENTER ITEM NO. YOU WANT

SPEED 0 TIME 1:25 TEMP 4.0

FIG. 4B

RESERVATION LIST 20 Jan 2000 11:10

No. User TIME (yyyy/mm/dd HH:MM)

1 Suzuki
2000/ 1/24 9:00 → 2000/ 1/25 11:00

2 Johnson
2000/ 1/25 13:00 → 2000/ 1/25 17:00

3

4

42

● ENTER "ID" CODE

43

FIG. 4C

RESERVATION LIST 20 Jan 2000 11:10

Nn. User TIME (yyyy/mm/dd HH:MM)

1 Suzuki
2000/ 1/24 9:00 → 2000/ 1/25 11:00

2 Johnson
2000/ 1/25 13:00 → 2000/ 1/25 17:00

3 ABC Lab.

4

44

45

WHAT DO YOU WANT ?
1:RESERVATION 2:DELETION

1

FIG. 4D

RESERVATION LIST 20 Jan 2000 11 : 10

| No. | User | TIME (yyyy/mm/dd HH : MM) |
|---|---|---|
| 1 | Suzuki | 2000/ 1/24 9 : 00 → 2000/ 1/25 11 : 00 |
| 2 | Johnson | 2000/ 1/25 13 : 00 → 2000/ 1/25 17 : 00 |
| 3 | ABC Lab. | 2000/ 1/20 11 : 10 → 2000/ 1/20 11 : 10 |
| 4 | | |

46

WHAT DO YOU WANT ?
1 : RESERVATION 2 : DELETION

1

FIG. 4E

RESERVATION LIST 20 Jan 2000 11 : 10

| No. | User | TIME (yyyy/mm/dd HH : MM) |
|---|---|---|
| 1 | Suzuki | 2000/ 1/24 9 : 00 → 2000/ 1/25 11 : 00 |
| 2 | Johnson | 2000/ 1/25 13 : 00 → 2000/ 1/25 17 : 00 |
| 3 | ABC Lab. | 2000/ 1/26 9 : 00 → 2000/ 1/26 15 : 00 |
| 4 | | |

47

● ACCEPTED

FIG. 5 himac LogManager 1.0

FILE(F) EDIT(E) TOOL(T) WINDOW(W) HELP(H)

CALCULATION ITEM himac LogManager 1.0

- ADMINISTRATION OF CENTRIFUGE
  - RECORD OF CENTRIFUGE OPERATION
  - PRESENT OPERATING CONDITIONS
  - LATEST OPERATION RESULT
  - PROGRAMMED OPERATION INFORMATION
- ADMINISTRATION OF ROTOR
  - ACTUAL ROTOR OPERATION
  - RECORD OF INDIVIDUAL ROTOR
- ADMINISTRATION OF USER
  - USER LIST
  - TOTAL OF INDIVIDUAL USER OPERATION
  - RECORD OF INDIVIDUAL USER OPERATION
- ADMINISTRATION OF EXPENSES
  - CALCULATION OF EXPENSES

ADMINISTRATION OF CENTRIFUGE · RECORD OF CENTRIFUGE OPERATION

MACHINE ID: 991000 DATA RENEWED: 1999/10/01

SEARCH DURATION: 1999/09/01 ---- 1999/10/01 SEARCH

| DATA/TIME | ROTOR | SER. NO. | ROTATION (rpm) | TIME (h:m) | USER | MEMO |
|---|---|---|---|---|---|---|
| 1999/09/01 | P100AT2 | 1234 | 65.000 | 4.00 | Lipoprotein Lab. | |
| 1999/09/02 | P65AT(RP65T) | 2100 | 65.000 | 2.00 | Hitachi | |
| 1999/09/06 | P100AT2 | 1234 | 65.000 | 5.00 | Lipoprotein Lab. | |
| 1999/09/07 | P83VT(SRP83VT) | 1800 | 65.000 | 5.00 | #1 Lab. | |
| 1999/09/08 | P100AT2 | 1234 | 65.000 | 4.00 | Lipoprotein Lab. | |
| 1999/09/10 | P65AT(RP65T) | 2100 | 50.000 | 2.00 | Hitachi | |
| 1999/09/13 | P28S2(SRP28SA1) | 3503 | 65.000 | 5.30 | T. Sato | |
| 1999/09/14 | P65AT(RP65T) | 2100 | 65.000 | 3.00 | Hitachi | |
| 1999/09/16 | P35ZT(RPZ35T) | 1101 | 65.000 | 10.00 | MIURA | |
| 1999/09/17 | P83VT(SRP83VT) | 1800 | 65.000 | 3.30 | #1 Lab. | |
| 1999/09/18 | P19A(RP19) | 1502 | 65.000 | 3.00 | Suzuki | |
| 1999/09/21 | P100AT2 | 1234 | 50.000 | 4.00 | Lipoprotein Lab. | |
| 1999/09/22 | P19A(RP19) | 1502 | 65.000 | 3.00 | Suzuki | |
| 1999/09/27 | P83VT(SRP83VT) | 1800 | 65.000 | 2.30 | #1 Lab. | |
| 1999/09/28 | P100AT2 | 1234 | 65.000 | 5.00 | Lipoprotein Lab. | |
| 1999/09/28 | P28S2(SRP28SA1) | 3503 | 65.000 | 5.30 | T. Sato | |
| 1999/09/29 | P19A(RP19) | 1502 | 65.000 | 3.00 | Suzuki | |
| 1999/09/30 | P65AT(RP65T) | 2100 | 50.000 | 3.00 | Hitachi | |

TOTAL NUMBER OF OPERATIONS: 1.8

TOTAL OPERATION TIME (hours): 73.0

CAPS 10.28

FIG. 6 himac LogManager 1.0

FILE(F) EDIT(E) TOOL(T) WINDOW(W) HELP(H)

CALCULATION ITEM himac LogManager 1.0

- ADMINISTRATION OF CENTRIFUGE
  - RECORD OF CENTRIFUGE OPERATION
  - PRESENT OPERATING CONDITIONS
  - LATEST OPERATION RESULT
  - PROGRAMMED OPERATION INFORMATION
- ADMINISTRATION OF ROTOR
  - ACTUAL ROTOR OPERATION
  - RECORD OF INDIVIDUAL ROTOR
- ADMINISTRATION OF USER
  - USER LIST
  - TOTAL OF INDIVIDUAL USER OPERATION
  - RECORD OF INDIVIDUAL USER OPERATION
- ADMINISTRATION OF EXPENSES
  - CALCULATION OF EXPENSES

61

ADMINISTRATION OF ROTOR · TOTAL OF INDIVIDUAL USER OPERATION

MACHINE ID: 991000 DATA RENEWED: 1999/10/01

ACTUAL OPERATION RATIO: FREQUENCY OF USE

SEARCH DURATION: 1999/09/01 ---- 1999/09/30 SEARCH

| USER | FREQUENCY OF USE | OPERATION TIME (h:m) | CUMULATIVE ROTATION (×E04) | ACTUAL OPERATION RATIO |
|---|---|---|---|---|
| Hitachi | 4 | 10.00 | 5.09E+06 | 22.22% |
| Test | 1 | 10.00 | 1.54E+06 | 5.56% |
| T. Sato | 2 | 11.00 | 1.10E+11 | 11.11% |
| Lipoprotein Lab. | 5 | 22.00 | 1.10E+11 | 27.78% |
| #1 Lab. | 3 | 11.00 | 5.18E+07 | 16.67% |
| Suzuki | 3 | 9.00 | 1.40E+05 | 16.67% |

TOTAL NUMBER OF OPERATIONS: 1.8

TOTAL OPERATION TIME (hours): 73.0

CUMULATIVE ROTATION NUMBER (×E04): 2.20E+11

CAPS 14.49

FIG. 7

INDIVIDUAL USER'S ACTUAL OPERATION

1999/10/2 9:18

MACHINE ID 991000 RENEWED DATE 1999/10/1

CALCULATION DATA OF ACTUAL OPERATION RATIO:
CUMULATIVE ROTATION

SEARCH TERM 1999/9/1~1999/10/1

| USER | FREQUENCY OF USE (TIMES) | OPERATION TIME (hh : mm) | CUMULATIVE ROTATION ($\times 10^4$) | ACTUAL OPERATION RATIO (%) | NOTE |
|---|---|---|---|---|---|
| LIPOPROTEIN LAB. | 5 | 10 : 00 | 6,000 | 53.72 | |
| Hitachi | 2 | 5 : 00 | 3,000 | 26.86 | |
| #1 LAB. | 2 | 2 : 00 | 1,050 | 9.40 | |
| DR. SUZUKI | 1 | 2 : 00 | 800 | 7.16 | |
| T. Sato | 1 | 2 : 17 | 290 | 2.60 | |
| MIURA | 1 | 1 : 00 | 30 | 0.27 | |
| | | | | | |
| | | | | | |
| | | | | | |
| | | | | | |
| | | | | | |
| | | | | | |
| | | | | | |
| | | | | | |
| | | | | | |

[FREQUENCY OF USE] 12 (TIMES)
[OPERATION TIME] 22 : 17 (hh : mm)
[CUMULATIVE ROTATION] 11,170 ($\times 10^4$)

FIG. 13

USED ROTOR LIST

| No. | Rotor Type | Last Run |
|---|---|---|
| 1 | P100AT2 | 2000/ 1/19 15:28 |
| 2 | P28S2 | 2000/ 1/18 16:42 |
| 3 | P27A | 2000/ 1/16 10:33 |
| 4 | P100VT | 2000/ 1/13 11:27 |
| 5 | P65AT | 2000/ 1/11 9:29 |
| 6 | OTHER ROTOR | |

● WHICH ROTOR NO. DO YOU SELECT ?

SPEED 0 TIME 0:25 TEMP 4.0

FIG. 14

USED ROTOR LIST

| No. | Rotor Type | SPEED | TIME | TEMP | A | D |
|---|---|---|---|---|---|---|
| 1 | P100AT2 | 100000 | 2:00 | 20.0 | 9 | 9 |
| 2 | P28S2 | 28000 | 10:30 | 4.0 | 7 | 5 |
| 3 | P27A | 27000 | 1:00 | 20.0 | 9 | 7 |
| 4 | P100VT | 100000 | 2:00 | 4.0 | 9 | 7 |
| 5 | P65AT | 65000 | 5:30 | 25.0 | 9 | 9 |
| 6 | OTHER ROTOR | | | | | |

● WHICH ROTOR NO. DO YOU SELECT ?

SPEED 100000 TIME 1:25 TEMP 4.0

FIG. 15

BASIC SCREEN 01 Apr 1996 11:10

| 150000 | 0:25 | 4.0 |
|---|---|---|
| SPEED rpm | TIME h:min | TEMP °c |
| 150000 | 1:00 | 4.0 |

ACCEL 9 DECEL 7 OPTION PROG RCFmax RCFavg RTC

VACUUM L H RUN

CENTRIFUGAL SEPARATOR AND ADMINISTRATION OF USER AND ACTUAL OPERATION OF THE SAME

BACKGROUND OF THE INVENTION

The present invention relates to user identification of a centrifugal separator and administration of actual operation data of the centrifugal separator.

In general, the life of each centrifugal separator is dependent on the durability of an actuator (e.g., a driving motor). The cumulative rotation number or the like of the centrifugal separator is a good indication for administrating the centrifugal separator.

Furthermore, when the centrifugal separating operation is performed at a higher rotational speed equivalent to 40,000 rpm or above, the life of a rotor accommodating a sample should be carefully managed based on the frequency of use or its operation time.

The published Japanese patent application No. 9117695 discloses a centrifugal separator which is capable of administrating actual operation data of the centrifugal separator for each user carrying an ID card.

SUMMARY OF THE INVENTION

An object of the present invention is to provide a centrifugal separator and its administration system capable of easily identifying each use of the centrifugal separator, and capable of performing various processing for storage, search, edit, and calculation as well as display and printout based on ample operation data of this centrifugal separator.

Furthermore, an object of the present invention provides a centrifugal separator and its administration system communicating with a personal computer for realizing an enhanced administration system.

In order to accomplish this and other related objects, the present invention provides a centrifugal separator comprising a motor serving as an actuator, a rotor driven by the motor, an input section for entering operating conditions of a centrifugal separation of a sample accommodated in the rotor, a display unit for displaying the operating conditions, a memory section for storing control data of the centrifugal separator as well as a user ID code and a corresponding user name which are registered in advance by a user, and user identifying means for identifying a user by checking whether a user ID code entered through the input section agrees with the registered user ID code.

Preferably, the centrifugal separator of the present invention can be embodied in the following manner.

The memory section stores a machine ID code used for identifying the centrifugal separator, in addition to the user ID code and the corresponding user name. A plurality of user ID codes can be assigned to each user, so that the user identifying means can identify the user based on the plurality of user ID codes.

The display unit does not display the user ID code during a registration of the user ID and when the user ID code is entered through the input section.

The display unit displays the user name corresponding to the user ID code while keeping the user ID code in secret, when user information needs to be displayed on the display unit for discriminating the user of the centrifugal separator and for discriminating the user of the actual operation data of the centrifugal separator.

The user name is a combination of characters and/or symbols which can identify the user.

An operation of the centrifugal separator is prohibited when the user identifying means judged that the user ID code entered through the input section disagrees with the registered user ID code.

A reservation of the centrifugal separator is allowed when both of the user ID code and the user name are accepted.

The reservation of the centrifugal separator and its change or cancel are allowed only when the user ID code is accepted.

The centrifugal separator executes data communication with a personal computer to share reservation data between the centrifugal separator and the personal computer, thereby allowing the user to make a reservation, and change or cancel the reservation at the personal computer.

The memory section stores actual operation data of the centrifugal separator together with operation conditions and the user name.

The actual operation data include at least one item selected from the group consisting of date/time of use, type of the rotor, manufacturing number of the rotor, rotation number, temperature, operation time, cumulative rotation number, user name, sample, solvent, solution, additive, used tube, used bottle, used adapter, and other special note.

The actual operation data are edited as a file data for each of individual users.

The actual operation data are classified into subclasses corresponding to individual users, a total cumulative rotation number of each user during a predetermined duration is measured, and an actual operation ratio of each user is obtained based on the total cumulative rotation number during the predetermined duration as a ratio of use of the centrifugal separator by the each user relative to an overall operation of the centrifugal separator.

The centrifugal separator is identified by a machine ID code which is attached to the actual operation data when the actual operation data are transmitted to an external device via a communication device.

The actual operation data transmitted to the external device include at least one item selected from the group consisting of the user ID code, user name list, record of use of the centrifugal separator, programmed operating conditions of the centrifugal separator, and record of use of the rotor.

Deletion of the actual operation data from the memory section is allowed when the actual operation data is successfully transmitted from the centrifugal separator to the external device.

Furthermore, the present invention provides an administration program for administrating an actual operation of a centrifugal separator installable in a personal computer performing data communication with a centrifugal separator, the administration program including the steps of: receiving actual operation data from the centrifugal separator, the actual operation data being classified into subclasses corresponding to individual users; processing the actual operation data for storage, administration, edit and calculation; and outputting result of the processing.

Preferably, the administration program of the present invention can be embodied in the following manner.

The administration program further comprises the steps of judging a machine ID code of the centrifugal separator attached to the actual operation data in the processing for storing the actual operation data of the centrifugal separator, and filing the actual operation data in accordance with the machine ID code.

The administration program further comprises a step of allowing a user to assign a new user name through the personal computer in the processing for administrating the actual operation data of the centrifugal separator, wherein the personal computer provides more characters and/or symbols available for registering the new user name compared with the characters and/or symbols usable in the centrifugal separator.

The processing for editing the actual operation data of the centrifugal separator is performed based on the data obtained during a predetermined duration.

A ratio of use of the centrifugal separator by each user relative to an overall operation of the centrifugal separator is obtained based on a total count selected from the group of frequency of use, operation time, cumulative rotation number, and any combination of them during a predetermined duration, in the processing for calculating the actual operation data of the centrifugal separator.

The editing or calculating result of the actual operation data of the centrifugal separator is rearranged in a predetermined printout format.

The printout format is editable or rearrangeable by the user, and the edited or rearranged printout format is stored in a memory of the personal computer.

Moreover, the present invention provides a centrifugal separator comprising a motor serving as an actuator, a rotor driven by the motor, a rotor housing in which the rotor is placed, a display unit displaying operating conditions and actual operation data, an operation panel allowing a user to set operating conditions and switch a screen image of the display unit, and a memory section storing the operating conditions. The centrifugal separator memorizes operating conditions of individual operations in the memory section when the rotor is driven according to arbitrary operating conditions, displays the individual operating conditions stored as an operation history, allows the user to select desirable operating conditions contained in the operation history, and displays the selected operating conditions as set values of the next operation of the centrifugal separator on the display unit.

Preferably, the above centrifugal separator of the present invention can be embodied in the following manner.

The centrifugal separator further comprises a rotor information input section for allowing the user to manually enter rotor information, wherein the rotor information entered from the rotor information input section is stored in the memory section as one of the operating conditions.

The centrifugal separator further comprises a clock section serving as a timekeeper for measuring an operation time of the centrifugal separator as well as a date/time of the centrifugal separating operation, wherein a start or end time of the centrifugal separating operation is stored in the memory section as one of the operating conditions.

The operation panel allows the user to register a user ID code, and the registered user ID code is stored in the memory section as one of the operating conditions.

The display unit displays last operating conditions of the rotor.

BRIEF DESCRIPTION OF THE DRAWINGS

The above and other objects, features and advantages of the present invention will become more apparent from the following detailed description which is to be read in conjunction with the accompanying drawings, in which:

FIGS. 2A to 2E are screen images of a centrifugal separator used in the registration of a user ID codes and a corresponding user name in accordance with the preferred embodiment of the present invention;

FIGS. 4A to 4E are screen images of the centrifugal separator used in the reservation of the centrifugal separator in accordance with the preferred embodiment of the present invention;

FIG. 5 is a screen image of a personal computer communicating with the centrifugal separator to display a "record of centrifuge operation" file in accordance with the preferred embodiment of the present invention;

FIG. 6 is a screen image of the personal computer communicating with the centrifugal separator to display a "total of individual user operation" file in accordance with the preferred embodiment of the present invention;

FIG. 7 is one of standard formats available for the personal computer communicating with the centrifugal separator in accordance with the preferred embodiment of the present invention, which is used for the printout of a printer;

FIG. 13 is a view showing a screen image of the display unit of the centrifugal separator in accordance with another preferred embodiment of the present invention;

FIG. 14 is a view showing a screen image of the display unit of the centrifugal separator in accordance with another preferred embodiment of the present invention;

FIG. 15 is a view showing a screen image of the display unit of the centrifugal separator in accordance with another preferred embodiment of the present invention;

DESCRIPTION OF PREFERRED EMBODIMENTS

Figure 1:
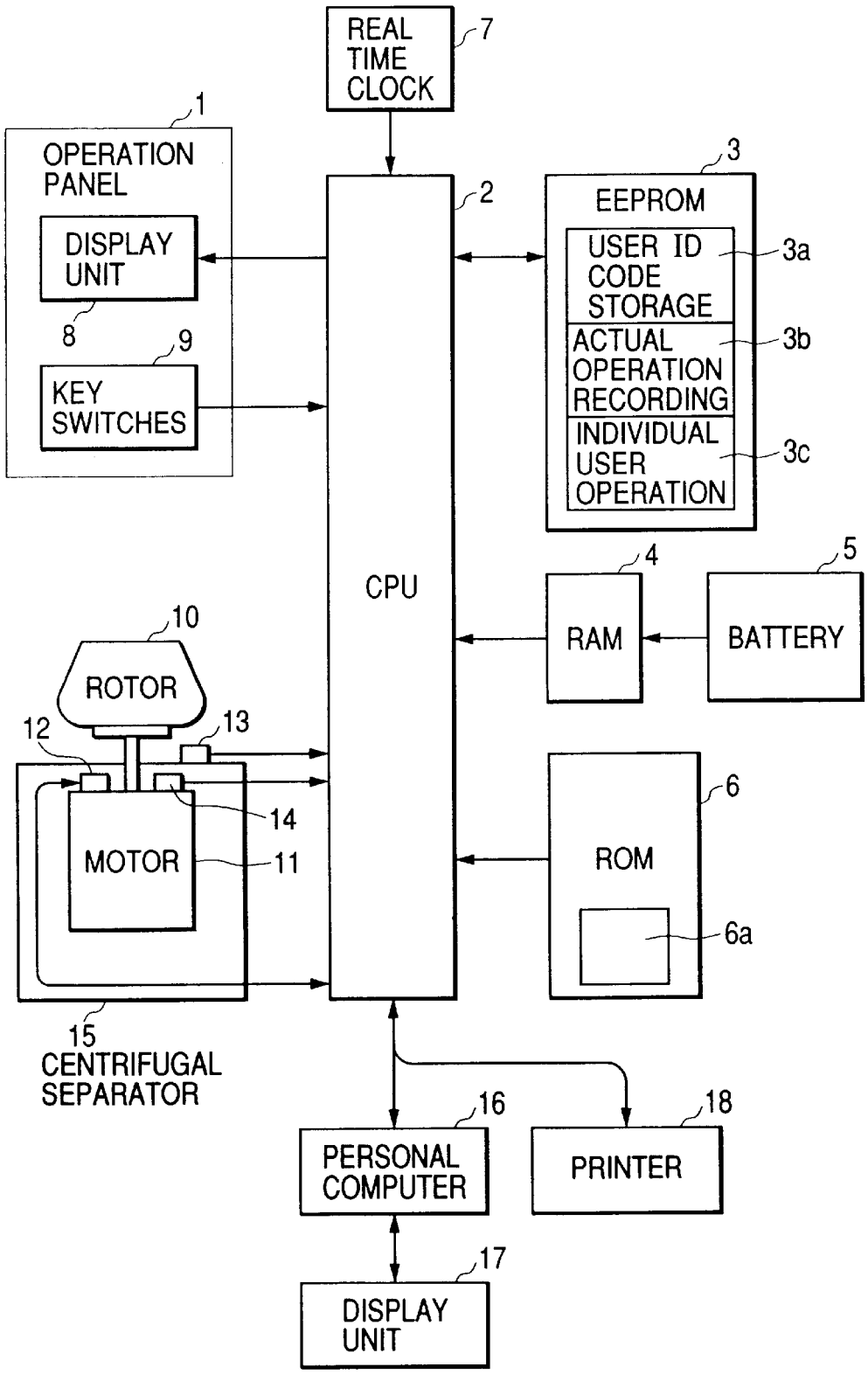
FIG. 1 is a block diagram showing a centrifugal separator and its administration system in accordance with a preferred embodiment of the present invention.

Preferred embodiments of the present invention will be explained with reference to attached drawings. Identical parts are denoted by the same reference numerals.

FIG. 1 is a block diagram showing a centrifugal separator 15 and its administration system in accordance with a preferred embodiment of the present invention.

In the administration system of the centrifugal separator 15, a control unit (e.g., CPU) 2 receives various data relating to operating conditions of the centrifugal separator 15 which are entered by an operator through key switches 9 on an operation panel 1. For example, the operating conditions of the centrifugal separator 15 include target values for a rotational speed, an operating time, a temperature, an acceleration gradient, a deceleration gradient, as well as a rotor type, a manufacturing number, and operator information. The received operating conditions are stored in a RAM 4 which is backed up by a battery 5 and displayed on the screen of a display unit 8.

A start switch is one of the key switches 9 on the operation panel 1. When an operator pushes the start switch, the control unit 2 accelerates the rotor 10 up to a predetermined speed. A temperature detector 13 detects a temperature of the rotor 10. The control unit 2 performs a feedback control based on a rotor temperature detected by the temperature detector 13 to equalize the temperature of the rotor 10 to a predetermined value. A motor (i.e., an actuator) 11 rotates the rotor 10. A rotational speed detector 12 detects a rotational speed of the motor The control unit 2 counts a pulse signal generated from the rotational speed detector 12. This pulse signal is, hereinafter, referred to a MPG signal. The count-up data of the pulse signal is temporarily stored in the RAM 4 and is renewed by the latest value representing the present rotor speed. Similarly, the control unit 2 counts a total operating time of the rotor 10 after the rotor 10 starts rotating. The count-up data of the rotor operation is stored in the RAM 4 and renewed by the latest value representing the rotor operation.

When the rotor rotational speed reaches a level of 1,000 $min^{-1}$ (i.e., permanent speed) during the acceleration, the control unit 2 controls the motor 11 to maintain the rotation of the rotor 10 at this permanent speed. A rotor discriminator 14 is provided in the vicinity of the rotor 10 to read the rotor information, including a rotor type and a manufacturing number, from the rotor 10. The readout rotor data is stored in the RAM 4. Then, the specification (e.g., max rotational speed, rotational min rotational radius, and max rotational radius) of this rotor 10 is read out from a rotor information area 6*a* of a ROM 6. The rotor information area 6*a* stores a rotor catalog including the information relating to the specifications of all rotors usable on this centrifugal separator 15. The RAM 4 temporarily stores the readout specifications of the rotor 10 presently mounted on the motor 11. After confirming the specification of the rotor 10 in this manner, the control unit 2 controls the motor 11 to accelerate the rotor 10 up to a target rotational speed.

When the rotor speed reaches the target rotational speed, the rotor speed is maintained for a predetermined operation time. Then, the control unit 2 decelerates the rotor 10 until the rotor 10 stops. Stop of the rotor 10 indicates an end of one complete centrifugal separating operation of the centrifugal separator 15. The control unit 2 stores the actual operation data of the centrifugal separator 15 during this operation. The actual operation data include the above permanent speed 1,000 $min^{-1}$, the rotor temperature at this permanent speed, the total operating time, and the cumulative rotation number (i.e., the count value of the MPG signal). In addition to these data, the control unit 2 reads a start date/time and an end date/time of one complete centrifugal operation based on clock data generated from a real time clock (RTC) 7. The real time clock 7 is a module product with a built-in crystal oscillator having clock and calender functions. All the data of one complete centrifugal operation are written into an actual operation recording area 3*b* in a read/write memory 3, such as an EEPROM, which requires no back-up of the battery 5.

The actual operation data of the centrifugal separator 15 thus stored in the read/write memory 3 can be transmitted to external devices, such as a personal computer 16 and a printer 18, via a communication line.

Next, a method of identifying each operator (i.e., user) based on the actual operation data of the centrifugal separator 15 will be explained.

Each operator using the centrifugal separator 15 is required to register his/her name and ID code in advance. When the user wants to register his/her name, the user manipulates the key switches 9 on the operation panel 1 to display a "USER LIST" screen shown in FIG. 2A. It is now assumed that the user selects a non-registered area 21 which is No. 9 on the "USER LIST" screen. In response to this selection, the lower part of the "USER LIST" screen changes as shown in FIG. 2B to require the user to elect one of three options: 1—registration; 2—change; and 3—deletion. When the user enters the elected number "1" into an input area 22, a "REGISTRATION OF USER NAME" screen is displayed as shown in FIG. 2C.

The "REGISTRATION OF USER NAME" screen is provided for allowing users to register registrant names (including nicknames or other characteristic names) by using eight characters or less for each. The characters usable for representing the registrant name include alphabets (both of uppercases and lowercases) and numbers (0~9) so that individual registrant name can be easily discriminable. After entering all of characters representing the registrant name, the user inputs "SET" to complete the registration. In response to the entry of "SET", the "USER LIST" screen appears again as shown in FIG. 2D.

The "USER LIST" screen of FIG. 2D indicates a newly registered name "ABC lab." in a space adjacent to No. 9. Meanwhile, the lower part of the "USER LIST" screen requests the user to enter an ID code (i.e., an identification code of the user). For example, the ID code is a combination of numbers and entered by the user through the ten keys (i.e., numerical keys) on the operation panel 1. When the user inputs the ID code of four digits, a cursor flashing section 25 indicates "****" instead of displaying the actual four-digit numbers representing the ID code. In this manner, the user ID code is kept in secret. When the entered ID code conflicts with any other ID, this entry is rejected as an error and the user is required to enter another ID code. Thus, the relationship between each user and his/her ID code is kept in a one-to-one relationship.

When the entry of the user ID code of four digits is accepted, the display screen changes to a "USER LIST" screen shown in FIG. 2E. The "USER LIST" screen of FIG. 2E indicates the date of registration in addition to the four symbols "**" concealing the ID code. The date of registration is displayed at a registered date area 27 on the "USER LIST" screen of FIG. 2E. It is preferable to register more detailed time information (hour, minute, second) together with the date. Through the above-described steps, the registration of a new registrant can be completed. The control unit 2 causes the read/write memory (e.g., EEPROM) 3 to store both the registered user ID code of four digits and a corresponding user name in a user ID code storage area 3***a*.

Figure 3A:
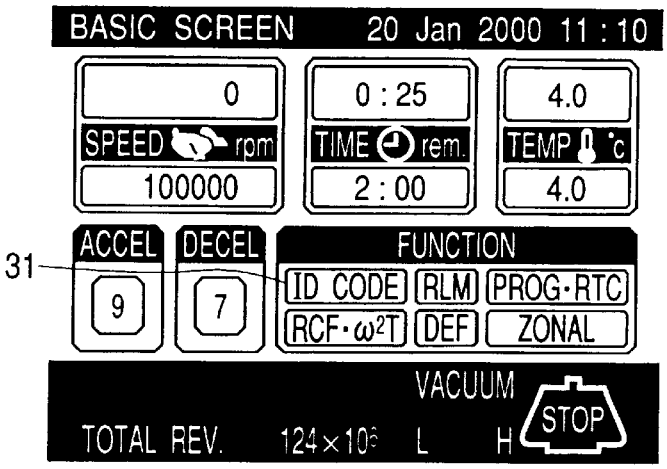
FIGS. 3A to 3C are screen images of the centrifugal separator used in the setting of user information when the centrifugal separator is operated in accordance with the preferred embodiment of the present invention.
Figure 3B:
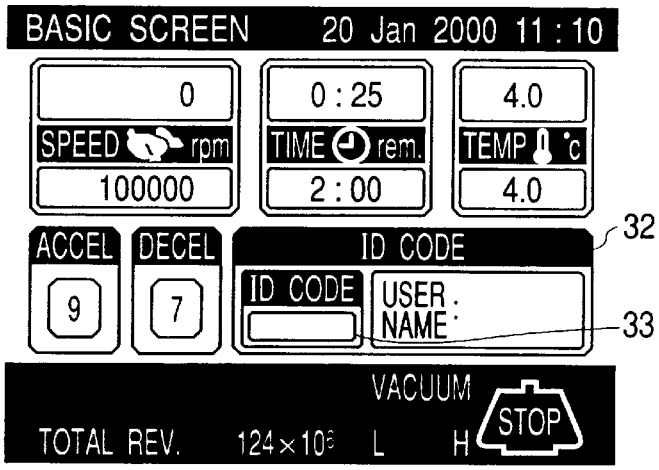

Next, after finishing the user registration, the user can start an operation of the centrifugal separator 15. First, the user turns on a power switch of the centrifugal separator 15. FIG. 3A is a "BASIC SCREEN" displayed in response to this turn-on operation. The "BASIC SCREEN" has a "FUNCTION" region including an "ID CODE" area 31. The "ID CODE" area 31 serves as an input request button for the user ID code. When the user selects the "ID CODE", the "FUNCTION" region changes to the image of an ID CODE section shown in FIG. 3B. On the "BASIC SCREEN" shown in FIG. 3B, a cursor section 33 is flashing until the user enters a user ID code. The user enters four-digit number representing the registered user ID code. During the reception of user ID code, the screen indicates "*" in response to each entry of number. After confirming the completion of entry of the four-digit number, the control unit 2 checks whether the entered ID code is a registered one or not with reference to the data stored in the user ID code storage area 3*a* of the EEPROM 3. If the entered ID code is a registered one, the user name "Suzuki" corresponding to the entered ID code is displayed in a "USER NAME" region 34. When the entered ID code is a non-registered one, the usage of this centrifugal separator 15 is basically prohibited. However, in a practical use, it may be preferable that the allowance or prohibition for the usage of the centrifugal separator is determined flexibly in each case depending on conditions or method of use.

Figure 3C:
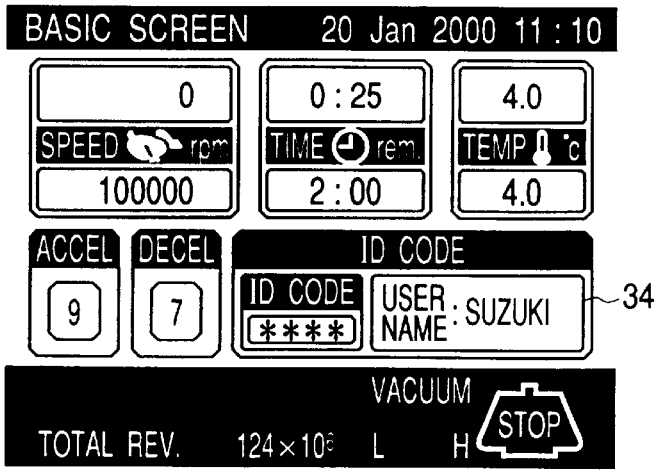

After the above procedure for entering the user ID code, the control unit 2 processes all of the actual operation data of the centrifugal separator 15 throughout one centrifugal separating operation. After the rotor 10 is stopped, all the data processed during one complete centrifugal separating operation is stored in the actual operation recording area 3*b* and also in an individual user operation area 3*c* in the read/write memory 3. Accordingly, even when the user is not present during the operation of the centrifugal separator 15, a third person can check a present user name 34 by selecting the "BASIC SCREEN" shown in FIG. 3C.

Next, one of functions of the centrifuge system of this embodiment is a "SCHEDULING OF CENTRIFUGE" function.

The centrifugal separator rotating at a speed exceeding 40,000 rpm is usually operated for several hours or one complete day depending on a sample to be separated. In the case of the centrifugal separator commonly used and administrated by a plurality of users, the operation schedule (i.e., time zones) of individual users may overlap with each other.

According to this embodiment, the user inputs "1" in a display area 41 on the "MENU SCREEN" shown in FIG. 4A to select the "SCHEDULING OF CENTRIFUGE" function. In response to the entry of "1", the display screen changes to a "RESERVATION LIST OF CENTRIFUGE" shown in FIG. 4B. When the user selects a reservation area 42 on the screen, a cursor portion 43 flashes to wait for entry of an ID code. When the user inputs a four-digit number representing his/her user ID code, the screen indicates "*" in response to each entry of four-digit number. The control unit 2 checks whether the entered ID code is a registered one or not with reference to the data stored in the user ID code storage area 3*a* of the EEPROM 3. If the entered ID code is a registered one, a user name "ABC lab." corresponding to the entered ID code is displayed at a reservation select portion 44 of the "RESERVATION LIST OF CENTRIFUGE" as shown in FIG. 4C. Next, the user enters "1" in a select region 45 to make a reservation. In response to the entry of "1", the display screen changes to the image of FIG. 4D. As a default value, the present time is displayed at a region 46 below the user name. The user can arbitrarily change the reservation time at a display portion 47 as shown in FIG. 4E. When the user finishes the reservation, the "RESERVATION LIST OF CENTRIFUGE" screen displays the user name and the reservation time for this user so that all of the users can mutually check their reservation times.

As described above, by effectively utilizing the user ID code and the user name, it becomes possible to make a schedule list of the centrifugal separator. Practically, in addition to the above function, the centrifuge system can possess the following functions.

① When the entered reservation date/time conflicts with a reservation by other person, the control unit 2 can reject this reservation and notify the user the denial by a message "Already reserved."

② When the entered reservation date/time conflicts with the previously reserved one by the same person (i.e., by the same user ID code), the control unit 2 notifies such a conflict and allows the user to change the previous reservation to a new one.

③ The control unit 2 allows specific persons, such as an administrant and a user himself/herself, to cancel the reservation.

④The schedule list is commonly owned by a centrifugal separator 15 and a personal computer 16 of each user which are connected via a communication line (e.g., LAN, Internet, telephone line, or various wireless communication devices) so that each user can easily make a reservation from his/her personal computer 16.

⑤The schedule list is commonly own by a centrifugal separator 15 and the personal computer 16 of each user which are connected via the communication line so that the schedule list of a predetermined duration can be displayed on a PC screen.

By adding the above-described functions, it becomes possible to improve the schedule list.

Regarding the lockout, it can be realized by strictly identifying the users.

Next, a method for strictly identifying users will be explained. Using a combination of a user ID code and a corresponding user name may cause a problem in strictly identifying each user. For example, when a user himself/herself registers his/her ID code, the same code is not accepted. Such an acceptance error occurs at a probability of 1/10,000 (0000~9999) in the case of using the user ID code of four digits. In other words, the registered user ID can be known by someone else with the probability of 1/10,000.

To avoid such a problem, it is desirable to:

① prohibit each user from registering his/her user ID code and exclusively allow an administrant of the centrifuge separator to perform a registration of the user ID code;

② reject the entry of the same ID code when failed three times successively; or

③ identify each user by a combination of the user ID code and the user name.

By employing one of the above three procedures, it becomes possible to avoid the acceptance error due to conflict of four-digit numbers. According to this embodiment, the user name consists of eight characters. The characters usable for the ID code registration are all of 26 alphabets (both uppercases and lowercases) and ten (=0~9) numbers. Thus, the probability of user names conflicting with each other is very low. The registration can be started by entering the user name. The user name is always attached to the actual operation data during display or print. Thus, the conflict of user names can be immediately judged as an acceptance error. In this case, the setting of the user information during the operation of the centrifugal separator is changed in the following manner.

First, in the "BASIC SCREEN" shown in FIG. 3A, the "ID CODE" 31 is selected. In response to this selection, the "USER LIST" screen shown in FIG. 2A is displayed. Then, the user selects his/her name on this "USER LIST" screen. In response to this selection, the screen image changes to the "USER LIST" screen shown in FIG. 3C. Then, the user enters his/her ID code of four digits, thereby completing the setting the user information.

When the number of input codes is not restricted, it is preferable that a plurality of user ID codes are assigned to each user. The check system requires the user to enter all of the assigned ID codes so that each user can be strictly identified. By using the above-described methods, an effective lockout system can be realized.

Next, the actual operation data of the centrifugal separator 15 stored in the centrifugal separator 15 are output in the following manner. Due to numerous data types and huge data capacity, only a limited amount of data is directly transmitted from the centrifugal separator 15 to the printer 18 in accordance with a request of a client. If required, all of the data can be transmitted to the personal computer 16 so that the personal computer 16 can perform the required processing based on the received data. The personal computer 16 possess a function of reading the actual operation data received from the centrifugal separator 15 and perform the required data processing. To this end, necessary programs can be loaded from a storage medium, such as a CD-ROM, to the personal computer 16. In other words, the personal computer 16 possesses an administration function.

The data transmission/reception is performed between the control unit 2 of the centrifugal separator 15 and the personal computer 16. The personal computer 16 chiefly transmits instructions (or commands) to the control unit 2 of the centrifugal separator 15 while the control unit 2 of the centrifugal separator 15 returns required data to the personal computer 16 in accordance with the received instructions. In this case, a machine ID code of the centrifugal separator 15 is always attached to the head of the return data sent from the control unit 2 to the personal computer 16.

The following is the details of the return data:

① recorded operation data of the centrifugal separator;
year, month, day, time (hour, minute), rotor code, rotor manufacturing number, user ID code, setting of $\omega^2t$, method of time administration, rotation number, operation time, temperature, acceleration gradient, deceleration gradient, $\omega^2t$, cumulative rotation number, sample, solution, used tube, used bottle, used adapter, and other special note, ② present operational conditions;
user ID code, setting of $\omega^2t$, rotation number, time, temperature, acceleration gradient, deceleration gradient, time administration conditions, rotor code, rotor manufacturing number, set value of $\omega^2t$, and set value of centrifugal separator, ③ latest operation result;
user ID code, setting of $\omega^2t$, rotation number (maximum rotational speed during the operation), operation time, temperature, acceleration gradient, deceleration gradient, time administration conditions, operation stop conditions, rotor code, rotor manufacturing number, set value of $\omega^2t$, and set value of centrifugal acceleration, ④ actual operation data of rotor;
registered number, rotor code, rotor manufacturing number, rotor type, presence of derating ("derating" is a procedure for lowering an allowable rotational speed of the rotor when the total time of use or an equivalent quantity exceeds a predetermined limit value), frequency of operations, and total operation time, ⑤ user list;
user registration date/time, user ID code, and user name, ⑥ programmed operating information;
rotation number, time, temperature, acceleration gradient, deceleration gradient, set value of centrifugal acceleration, and set value of $\omega^2t$ for each memory step ("memory step" is an individual memory area into which each condition is stored when one complete operation includes a plurality of set data relating to the rotation number, time, and the like, and the operation is continuously performed).

When the personal computer 16 receives the above-described return data from the control unit 2 of the centrifugal separator 15, the personal computer 16 reads the machine ID code of the centrifugal separator 15 attached at the head of the return data. Then, the personal computer 16 stores the return data in a data file of its built-in memory device.

Among the above-described data, the data relating to the actual operation is only the recorded operation data of the centrifugal separator 15 (i.e., item ①). The item ① contains all of operating conditions relating to the operation and use of the centrifugal separator 15. In this case, the user information involved in the item ① is only the user ID code. Thus, to identify the user name, the personal computer 16 can check the user list (i.e., item ⑤) based on the user ID code.

An actual usage administrating program for the centrifugal separator 15 is run in the personal computer 16. Thus, the personal computer 16 executes various processing required for search, edit, calculation and transmission of data by using the inherent data processing capability of the personal computer. Accordingly, the administration of the centrifugal separator 15 can be easily and smoothly done compared with a case where the data processing is executed in the centrifugal separator 15.

For example, the user name usable in the centrifugal separator 15 is substantially restricted to a combination of eight characters selected from the group of 26 alphabets (both uppercases and lowercases) and ten (=0~9) numbers. On the other hand, due to ample acceptability of registration characters, the personal computer allows the registration of numerous user names involving other characters, such as kanji (Chinese letter), hiragana, katakana, or the else. Thus, each user can register his/her user name by directly inputting a true name or a complicated name of the user.

To this end, based on the user list (i.e., item ⑤) sent from the control unit 2 of the centrifugal separator 15, the personal computer 16 can display the user name including kanji (Chinese letter), hiragana, and katakana on its display unit 17. In other words, the personal computer 16 allows each user to assign a new user name. The acceptable new user name (i.e., newly registered user name) can include kanji (Chinese letter), hiragana, and katakana, so as to correspond to the user ID sent from the control unit 2 of the centrifugal separator 15. When there is no need of using a user name including kanji (Chinese letter), hiragana, and katakana, the personal computer 16 directly displays the user name already registered by the control unit 2 of the centrifugal separator 15. Needless to say, a character string of registration characters is formed by using language characters and symbols installed in the personal computer 16.

FIG. 5 is a screen image of the personal computer 16 used for displaying the data of a "record of centrifuge operation" file which is one of subclasses belonging to an "administration of centrifuge" file. The centrifugal separator 15 has the machine ID code registered in the same manner as the user ID code. The personal computer 16 can process the actual operation data of a plurality of centrifugal separators. The personal computer 16 has a plurality of files corresponding to respective centrifugal separators. The actual operation data of each centrifugal separator 15 is stored in the individual file corresponding to the machine ID code of this centrifugal separator. According to this embodiment, FIG. 5 shows the data stored in the file corresponding to the machine ID code "991000." Furthermore, the search duration is set to a term starting from Sep. 1, 1999 (i.e., 1999/09/01) and ending at Oct. 1, 1999 (i.e., 1999/10/1). The history of use of the centrifugal separator having the machine ID code of 9910000 is displayed in order of data.

As described above, a user can register his/her name through the personal computer 16 by using kanji (Chinese letter), hiragana, and katakana. As one of examples, FIG. 5 shows a user name "リポタンパク研究室 (lipoprotein Laboratory)" which is expressed by using kanji and katakana. According to the user list shown in FIG. 2A, the user name "Lipo. Gr" registered in the centrifugal separator corresponds to the user name "リポタンパク研究室 (lipoprotein Laboratory)" registered through the personal computer 16. The personal computer 16 uses the characters "リポタンパク研究室 (lipoprotein Laboratory)" as a user name to be printed out by a printer as well as a user name to be displayed on the screen of display unit 17. A "memo" space is provided to allow the user to enter the operating conditions etc. through a keyboard of the personal computer 16.

The "memo" space is, for example, used for describing: ① purpose of centrifugal separation; ② name of sample to be subjected to the centrifugal separation; ③ name of solvent or solution; ④ name of additive; and ⑤ other matters. The contents described in this "memo" space can be used in the data search and also in the data processing as recorded items attached to the selected actual operation data.

Next, the details of calculation and edit functions of the personal computer 16 will be explained with reference to the data of a "total of individual user operation" file which is one of subclasses belonging to the "administration of user" file shown in FIG. 6. This screen displays a list of frequency of use, total operation time, and cumulative rotation number based on the actual operation data during the term of Sep. 1, 1999 (i.e., 1999/09/01) to Sep. 31, 1999 (i.e., 1999/9/31). To display this list, the personal computer 16 accesses the data of the "record of centrifuge operation" file corresponding to the centrifuge separator having the machine ID 991000 to obtain the data during the term of Sep. 1, 1999 (i.e., 1999/09/01) to Sep. 31, 1999 (i.e., 1999/9/31).

The personal computer 16 classifies and edits the collected data for individual users and calculates a total frequency of use, a total operation time, and a total cumulative rotation number for each of the individual users. The calculated result is displayed on the screen shown in FIG. 6, together with an actual operation ratio. The actual operation ratio of each user indicates a percentage of use of this centrifugal separator by each user relative to the overall operation of this centrifugal separator. The actual operation ratio of each user can be obtained based on any one of the total frequency of use, the total operation time, and the total cumulative rotation number, or based on any combination of them.

In this manner, the personal computer 16 performs the search and the edit with respect to the common items of user name and used rotor based on the record of operation data received from the centrifugal separator. Especially, regarding the data processing for individual users, the personal computer can calculate the total frequency of use, the total operation time, and the cumulative rotation number for each user, as well as the actual operation ratio representing each individual operation data relative to the overall operation data. The personal computer 16 has a function of calculating a share of expenses for each user based on of the actual operation ratio of each user. More specifically, the display screen of FIG. 6 shows a display area 61 for allowing the user to select the "calculation of share of expenses" which is one of subclasses of the "administration of expenses" file.

Next, a printout image of the printer 18 will be explained. The currency used in the "calculation of share of expenses" is not limited to "yen" and therefore can be replaced by "dollar" or other foreign currency.

The personal computer 16 has a function of transmitting the result of search, edit and calculation performed based on the record of centrifuge operation to the printer 18. The personal computer 16 stores various kinds of standard formats in its memory device. Thus, the personal computer 16 incorporates the data into a selected standard format. The printer 18 outputs the data in the selected standard format. The format can be flexibly edited and reorganized in accordance with user's request or administrant's request of the centrifugal separator. The personal computer can store the modified format as a standard format which is stored in its memory device. Furthermore, the personal computer can rearrange the newly stored format.

Figure 8:
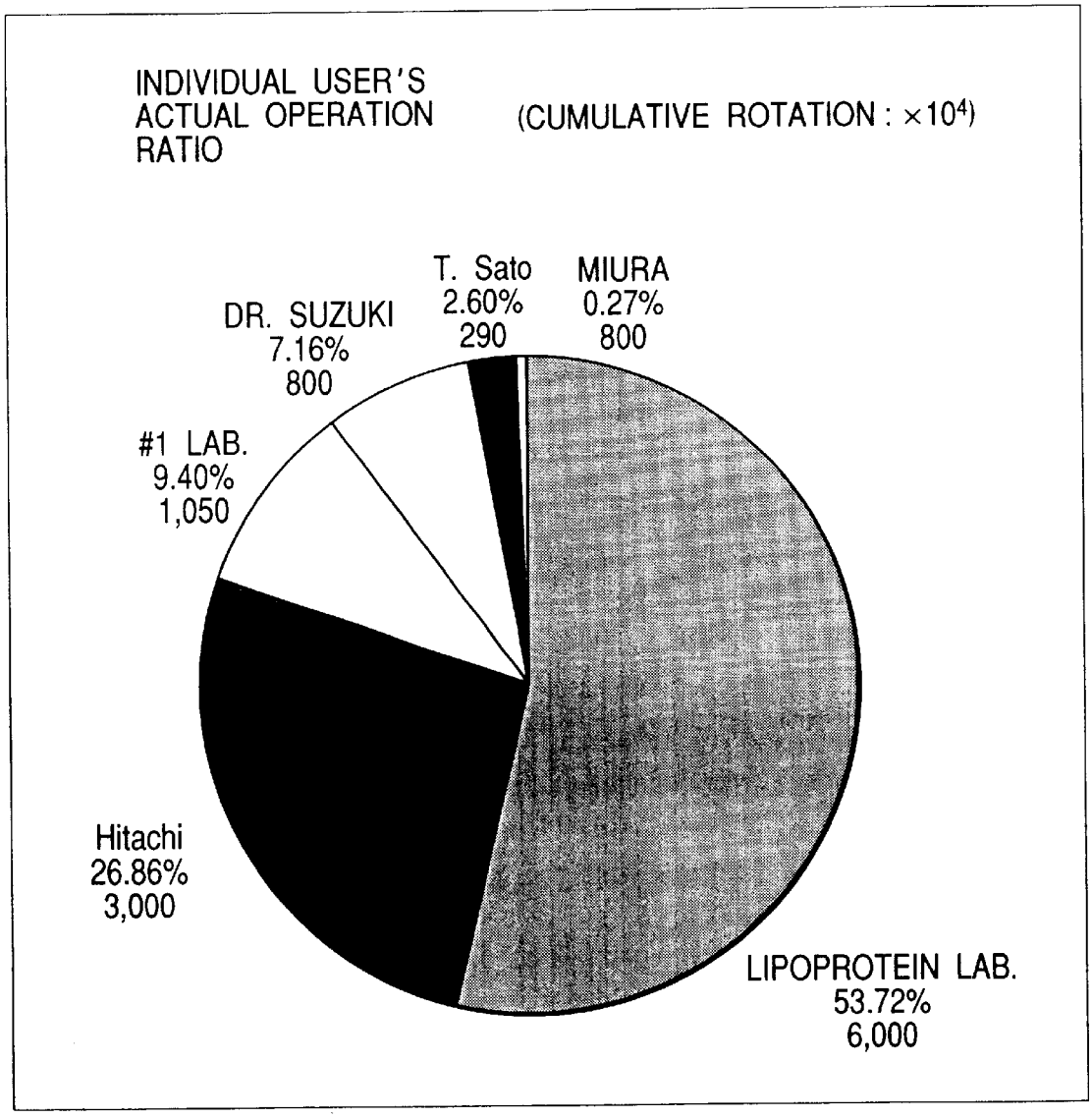
FIG. 8 is a circular graph available for the personal computer communicating with the centrifugal separator in accordance with the preferred embodiment of the present invention, which is used in the printout of the printer in accordance with the preferred embodiment of the present invention.

FIG. 7 shows one of the standard formats for the actual operation data of an individual user. This standard format has a size of A4 so that the administrant of the centrifugal separator can easily store the records of users. FIG. 8 is a circular graph showing calculation result of the actual operation ratio of individual users.

Deletion of the actual operation data from the read/write memory 3 of the centrifugal separator 15 is allowed when the actual operation data is successfully transmitted to the personal computer 16.

Figure 9:
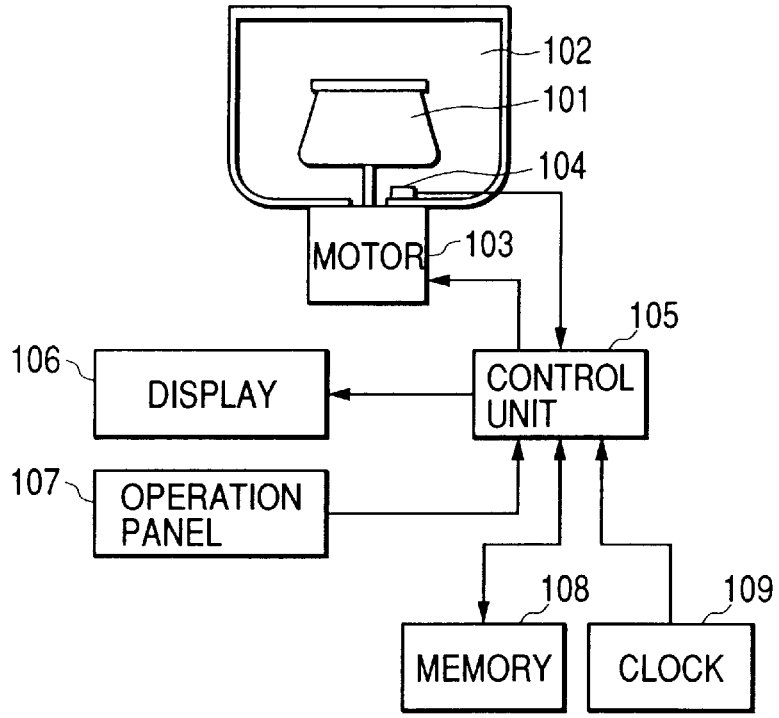
FIG. 9 is a block diagram showing a centrifugal separator and its administration system in accordance with another preferred embodiment of the present invention.
Figure 11:
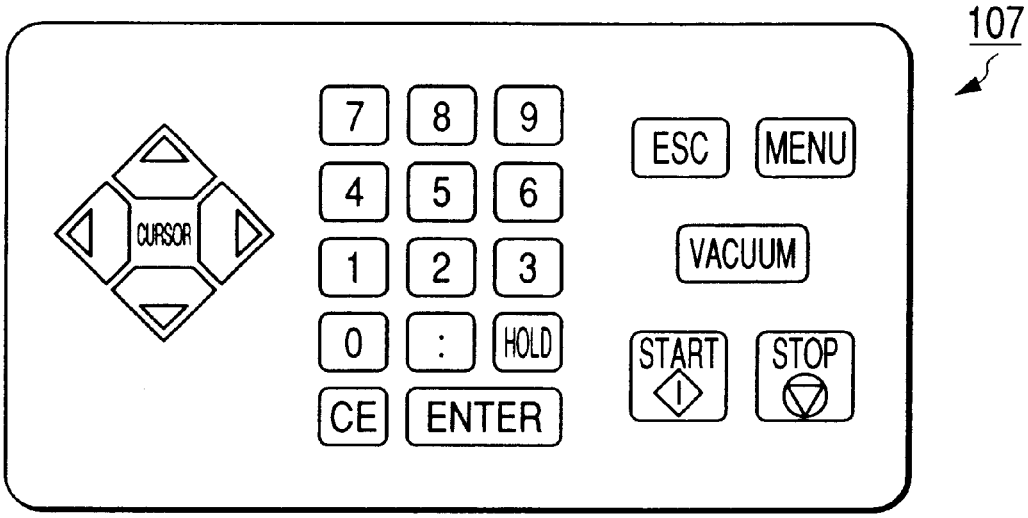
FIG. 11 is a view showing an operation panel of the centrifugal separator in accordance with another preferred embodiment of the present invention.

FIG. 9 shows a centrifugal separator and its administration system in accordance with the present invention. A rotor 101 accommodating a sample is placed in a rotor housing 102. A motor 103, serving as an actuator, rotates the rotor 101. A user enters commands and data through an operation panel 107 shown in FIG. 11. Various control items, such as rotational speed of motor 103, operation time of motor 103, temperature of rotor 101 or rotor housing 102, acceleration gradient of rotor 101 or motor 103, and deceleration gradient of the same, are set by the user through the operation panel 107. A control unit 105 receives the set values from the operation panel 107. A rotor information sensor 104 is placed near the rotor 103 in the rotor housing 102 to detect presence of the rotor 103 and read the rotor information including rotor type, manufacturing number, frequency of use, and cumulative rotation number, from the rotor 101. The rotor information thus detected by the rotor information sensor 104 is transmitted to the control unit 105.

Figure 10:
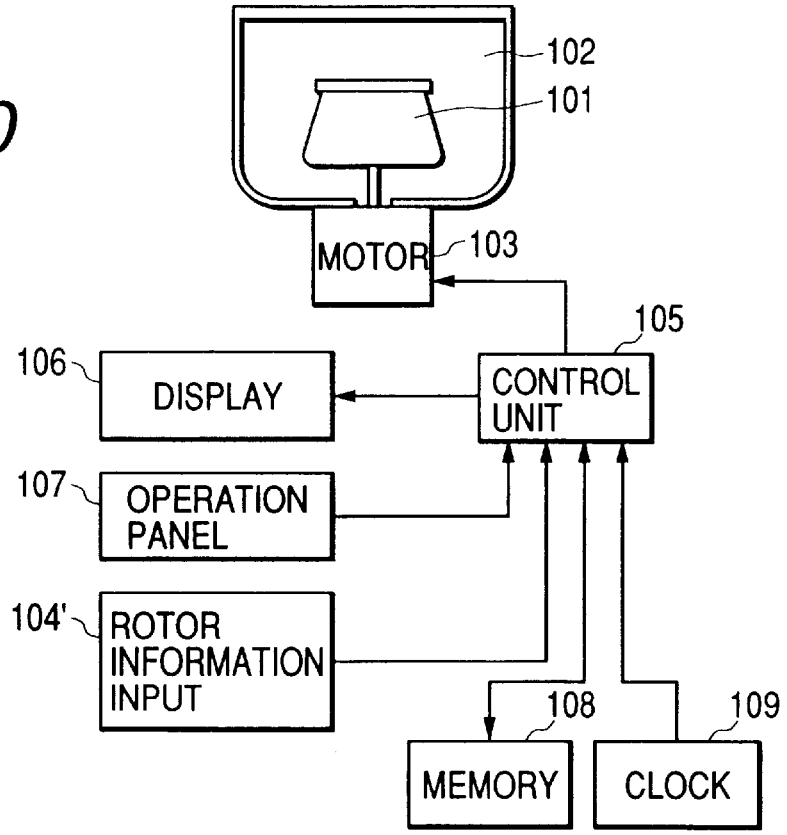
FIG. 10 is a block diagram showing a modified centrifugal separator and its administration system in accordance with the another preferred embodiment of the present invention.

FIG. 10 shows a modified centrifugal separator and its administration system in accordance with the present invention. The centrifugal separator shown in FIG. 10 differs from the centrifugal separator shown in FIG. 9 in that a rotor information input unit 104' is located outside the rotor housing 102. The rotor information input unit 104' accepts manual input of the rotor information by the user. The rotor information thus entered by the user through the rotor information input unit 104' is transmitted to the control unit 105.

Although not shown, it is possible to provide both of the rotor information sensor 104 and the rotor information input unit 104' as a modified centrifugal separator in accordance with the present invention.

In any of the centrifugal separators shown in FIGS. 9 and 10 or its modification, the control unit 105 receives the information entered by the user through the operation panel 107 and/or rotor information input unit 104'. The received information is stored in a memory section 108 in the form of a data list shown in the table 1. The control unit 105 inputs time data from a clock section 109 which serves as a timekeeper for measuring an operation time of the centrifugal separator as well as a date/time (i.e., year, month, day, hour, minute, second) of the centrifugal separating operation. The received time data is stored in the memory section 108.

Figure 12:
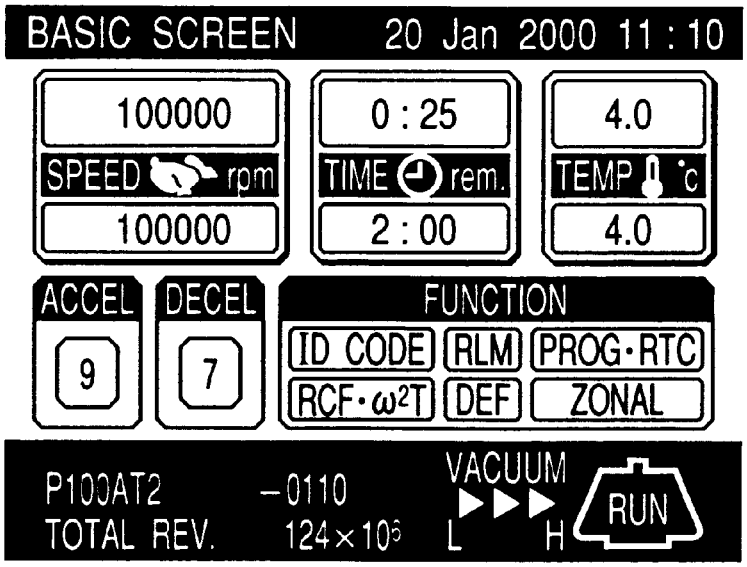
FIG. 12 is a view showing a screen image of a display unit of the centrifugal separator in accordance with another preferred embodiment of the present invention.

A display unit 106 is connected to the control unit 105 to display the set values of the centrifugal separating operation which are all or part of the information stored in the memory section 108. Furthermore, the display unit 106 can display the measured actual operating data (i.e., present rotational speed, operation time, temperature, etc) of the centrifugal separator. FIGS. 12 to 14 show examples of screen images of the display unit 106.

Figure 16:
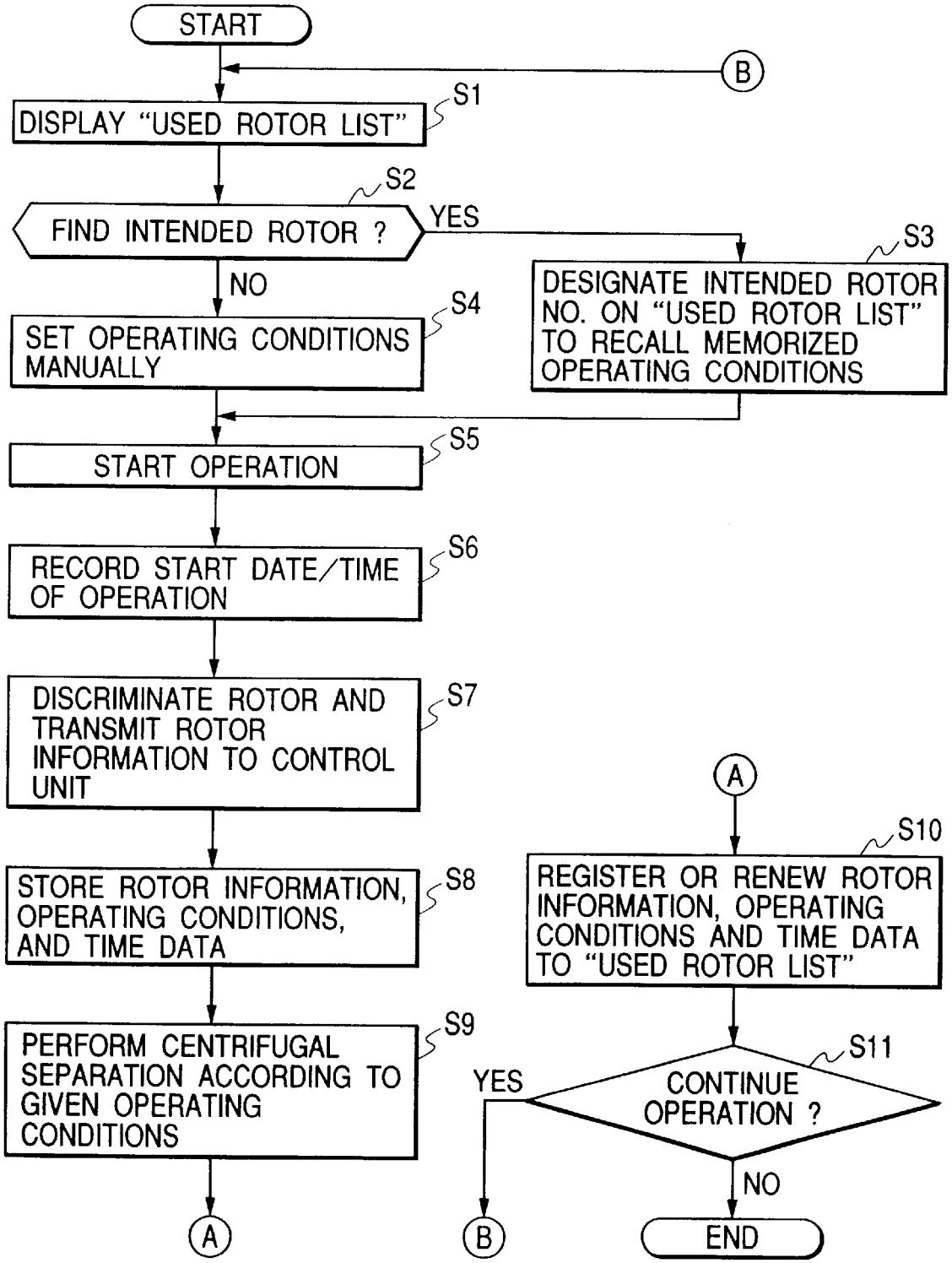
FIG. 16 is a flowchart showing an operation of the centrifugal separator in accordance with another preferred embodiment of the present invention.

FIG. 16 is a flowchart showing an operation of the centrifugal separator shown in FIG. 9.

First, the centrifugal separator is turned on, the display unit 106 displays a "BASIC SCREEN" shown in FIG. 12. The user manipulates a cursor key (e.g., an "up" cursor key) on the operation panel 107 shown in FIG. 11 to select a screen of "USED ROTOR LIST" shown in FIG. 13 (refer to step S1). The "USED ROTOR LIST" indicates the history of past operations of the used rotors. According to the example shown in FIG. 13, the "USED ROTOR LIST" contains the rotor type and the date/time of last operation. When the user finds an intended rotor (i.e., a rotor that the user wants to use) in this "USED ROTOR LIST" (i.e., YES in step S2), the user can select the intended rotor by simply manipulating a cursor key. For example, the user designates the rotor of No. 1 in FIG. 13. In response to this selection, the screen image of the display unit 106 returns to the "BASIC SCREEN" which recalls the set values of the operating conditions during the last operation of the selected rotor (refer to step S3). In FIG. 12, the recalled set values are displayed in the numerical display spaces below the indications of "SPEED", "TIME", and "TEMP", respectively. Meanwhile, present operating conditions are displayed in the numerical display spaces above the indications of "SPEED", "TIME", and "TEMP", respectively.

When the user does not find the intended rotor in this "USED ROTOR LIST" shown in FIG. 13 (i.e., NO in step S2), the user manually sets operating conditions on the "BASIC SCREEN" by manipulating the switches on the operation panel 107 (refer to step S4).

After accomplishing the setting of the operating conditions (at the step S3 or S4), the user can start the operation of the centrifugal separator (refer to step S5). The control unit 105 inputs time data from the clock section 109 to record the start date/time (e.g., year, month, day, hour, minute, second) of the centrifugal separating operation (refer to step S6). The rotor information sensor 104 discriminates the rotor and transmits the detected rotor information to the control section 105 (refer to step S7).

The control unit 1 stores the received rotor information, operating conditions and start date/time information in the memory section 108. Then, the centrifugal separator performs a centrifugal separating operation (including the acceleration, constant-speed rotation, deceleration, and stop of the rotor) according to the given operating conditions (refer to step S9). The control unit 105 can record the stop date/time (e.g., year, month, day, hour, minute, second) of the centrifugal separating operation based on time data obtained from the clock section 109. After finishing the centrifugal operation, the control unit 105 registers or renews the rotor information, operating conditions, and start/stop time information stored in the memory section 108 in the data space dedicated to the corresponding rotar type in the "USED ROTOR LIST" (refer to step S10). When the user repeats the operation of the centrifugal separator (i.e., YES in step S11), the user selects a desirable rotor based on the renewed "USED ROTOR LIST" (refer to step S1).

TABLE 1

| No. | 1 | 2 | 3 | 4 | 5 |
|---|---|---|---|---|---|
| ROTOR | P100AT2 | P28S2 | P100VT | P100AT2 | P65AT |
| MANUFACTURING NO. | 1234 | 2225 | 0110 | 1234 | 1536 |
| SPEED (rpm) | 100,000 | 28,000 | 100,000 | 90,000 | 65,000 |
| TIME | 1 Hr 30 Min | 10 Hr 30 Min | 3 Hr | 2 Hr 30 Min | 5 Hr 30 Min |
| TEMP (° C.) | 4 | 20 | 20 | 20 | 25 |
| ACCEL. | 9 | 7 | 9 | 9 | 9 |
| DECEL. | 7 | 5 | 7 | 7 | 9 |
| USED TUBE | 4.7 PC | 16 PA | 5 PA SEAL TUBE | 4.7 PC | 12 PC |
| SAMPLE | lipoprotein | RNA | plasmid DNA | lipoprotein | RNA |
| SOLUTION/ SOLVENT ETC | CsCl, specific gravity 1.2 | 5~25% density gradient | CaCl, specific gravity 1.57 | KBr, specific gravity 1.06 | CsCl, specific gravity 1.15 |
| OPERATION DATE (START) | Jan. 20, 2000 13:20 | Jan. 22, 2000 09:35 | Jan. 23, 2000 09:35 | Jan. 25, 2000 09:45 | Jan. 28, 2000 11:20 |
| USER NAME | Suzuki | Johnson | Michael | Sato | Suzuki |

The table 1 includes the data relating to rotor type, manufacturing number (or private code), rotational speed, operation time, operation temperature, acceleration gradient, deceleration gradient, used tube (or used bottle or private adapter), sample, solution/solvent/additive, operation date/time, user name, and special note.

Figure 17:
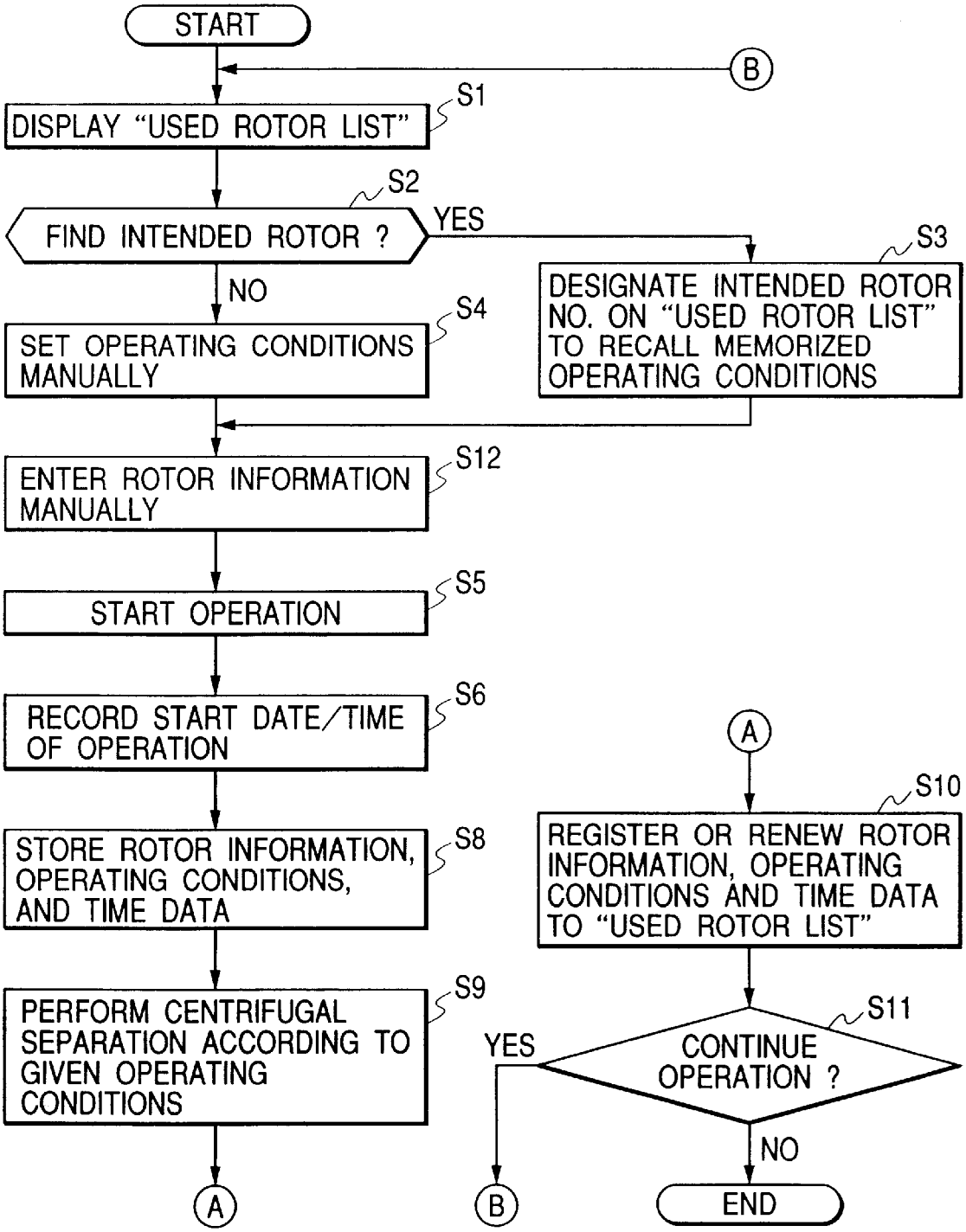
FIG. 17 is a flowchart showing a modified operation of the centrifugal separator in accordance with another preferred embodiment of the present invention.

FIG. 17 is a flowchart showing an operation of the centrifugal separator shown in FIG. 10. The flowchart of FIG. 17 differs from the flowchart of FIG. 16 in that the step S7 is removed and a step S12 is provided between the step S4 and the step S5. In the step S12, the user manually enters rotor information through the rotor information input unit 104'.

FIG. 14 shows another "USED ROTOR LIST" modified based on the data of the table 1, wherein the rotation speed, the operation time, and the operation temperature are displayed. It is also possible to display the history of the operations performed by each user, or to display a list including the data classified according to the operation date/time or according to the sample. When the display unit 106 has a large size, it will be possible to display all of the operation data in accordance with a request of the user. The user can select the operation data from these data. The selected data are displayed on the display unit 106. In this case, to keep the private data in secret, it is preferable to allow the user to display the requested operation history only when the true or valid user ID code is entered through the operation panel 107. The true or valid user ID code can be stored in the memory section 108.

This invention may be embodied in several forms without departing from the spirit of essential characteristics thereof. The present embodiments as described are therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A centrifugal separator comprising:

a motor serving as an actuator;

a rotor driven by said motor;

an input section for entering operating conditions of a centrifugal separation applied to a sample accommodated in said rotor;

a display unit for displaying the operating conditions;

a memory section for allowing a user to register in advance a user ID code and a user name corresponding to said user ID code and storing control data of said centrifugal separator in connection with said user ID code and said corresponding user name; and user identifying means for identifying a user by checking whether a user ID code entered through said input section agrees with said registered user ID code, wherein said display unit displays said user name registered in said memory section while keeping said user ID code entered through said input section in secret when said user ID code entered through said input section agrees with said registered user ID code, wherein said display unit has a display area for indicating entry of said user ID code and a display area for displaying said user name.

2. The centrifugal separator in accordance with claim 1, wherein said memory section stores a machine ID code used for identifying said centrifugal separator, in addition to said user ID code and the corresponding user name.

3. The centrifugal separator in accordance with claim 1, wherein a plurality of user ID codes are assigned to each user, and said user identifying means identifies the user based on said plurality of user ID codes.

4. The centrifugal separator in accordance with claim 1, wherein said display unit does not display said user ID code during a registration of said user ID and when said user ID code is entered through said input section.

5. The centrifugal separator in accordance with claim 1, wherein said user name is a combination of characters and/or symbols which can identify the user.

6. The centrifugal separator in accordance with claim 1, wherein an operation of said centrifugal separator is prohibited when the user identifying means judged that the user ID code entered through said input section disagrees with said registered user ID code.

7. The centrifugal separator in accordance with claim 1, wherein a reservation of said centrifugal separator is allowed when both of said user ID code and said user name are accepted.

8. The centrifugal separator in accordance with claim 7, wherein the reservation of said centrifugal separator and its change or cancel are allowed only when said user ID code is accepted.

9. The centrifugal separator in accordance with claim 7, wherein said centrifugal separator executes data communication with a personal computer to share reservation data between the centrifugal separator and the personal computer, thereby allowing the user to make a reservation, and change or cancel the reservation at the personal computer.

10. The centrifugal separator in accordance with claim 1, wherein said memory section stores actual operation data of said centrifugal separator together with operation conditions and the user name.

11. The centrifugal separator in accordance with claim 10, wherein said actual operation data include at least one item selected from the group consisting of date/time of use, type of the rotor, manufacturing number of the rotor, rotation number, temperature, operation time, cumulative rotation number, user name, sample, solvent, solution, additive, used tube, used bottle, used adapter, and other special note.

12. The centrifugal separator in accordance with claim 10, wherein said actual operation data are edited as a file data for each of individual users.

13. The centrifugal separator in accordance with claim 10, wherein said actual operation data are classified into subclasses corresponding to individual users, a total cumulative rotation number of each user during a predetermined duration is measured, and an actual operation ratio of each user is obtained based on the total cumulative rotation number during said predetermined duration as a ratio of use of said centrifugal separator by said each user relative to an overall operation of said centrifugal separator.

14. The centrifugal separator in accordance with claim 10, wherein said centrifugal separator is identified by a machine ID code which is attached to said actual operation data when said actual operation data are transmitted to an external device via a communication device.

15. The centrifugal separator in accordance with claim 14, wherein said actual operation data transmitted to said external device include at least one item selected from the group consisting of the user ID code, user name list, record of use of said centrifugal separator, programmed operating conditions of said centrifugal separator, and record of use of said rotor.

16. The centrifugal separator in accordance with claim 14, wherein deletion of said actual operation data from said memory section is allowed when said actual operation data is successfully transmitted from said centrifugal separator to said external device.

17. A centrifugal separator comprising:

a motor serving as an actuator;

a rotor driven by said motor;

a rotor housing in which said rotor is placed;

a display unit displaying operating conditions and actual operation data;

an operation panel allowing a user to set operating conditions and switch a screen image of said display unit;

a memory section storing the operating conditions, wherein said memory section memorizes operating conditions of individual operations when said rotor is driven according to arbitrary operating conditions, and said display unit displays after finishing the individual operations said individual operating conditions stored in said memory section as an operation history, said centrifugal separator further comprises a selecting means for allowing in a next operation the user to select a desirable one of the operating conditions contained in said operation history, said display unit displays the selected desirable operating condition as set values of the next operation of the centrifugal separator, and said rotor performs the next operation based on the selected desirable operating condition.

18. The centrifugal separator in accordance with claim 17, further comprising a rotor information input section for allowing the user to enter rotor information, wherein the rotor information entered from said rotor information input section is stored in said memory section as one of the operating conditions.

19. The centrifugal separator in accordance with claim 17, further comprising a clock section serving as a timekeeper for measuring an operation time of the centrifugal separator as well as a date/time of the centrifugal separating operation, wherein a start or end time of the centrifugal separating operation is stored in said memory section as one of the operating conditions.

20. The centrifugal separator in accordance with claim 17, wherein said operation panel allows the user to register a user ID code, and the registered user ID code is stored in the memory section as one of the operating conditions.

21. The centrifugal separator in accordance with claim 17, wherein the display unit displays lasting operating conditions of said rotor.

* * * * *

UNITED STATES PATENT AND TRADEMARK OFFICE

CERTIFICATE OF CORRECTION

PATENT NO. : 6,679,821 B1
DATED : January 20, 2004
INVENTOR(S) : Satoshi Numata et al.

It is certified that error appears in the above-identified patent and that said Letters Patent is hereby corrected as shown below:

Title page,
Item [73], Assignee, change "Hitachi Koko" to -- Hitachi Koki --

Signed and Sealed this

Twenty-first Day of September, 2004

JON W. DUDAS
*Director of the United States Patent and Trademark Office*